US010345066B2

(12) United States Patent
Agnelli, Jr.

(10) Patent No.: US 10,345,066 B2
(45) **Date of Patent: *Jul. 9, 2019**

(54) PISTOL FRAME DISASSEMBLY BED WITH SINGLE PIECE AND MULTI-PIECE CONSTRUCTIONS

(71) Applicant: Vincent R Agnelli, Jr., Catlett, VA (US)

(72) Inventor: Vincent R Agnelli, Jr., Catlett, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/418,780

(22) Filed: Jan. 30, 2017

(65) Prior Publication Data

US 2017/0254608 A1 Sep. 7, 2017

Related U.S. Application Data

(63) Continuation-in-part of application No. 15/062,052, filed on Mar. 5, 2016, now Pat. No. 9,958,224.

(51) Int. Cl.
*F41A 11/00* (2006.01)
*F41C 3/00* (2006.01)
*F41A 23/18* (2006.01)

(52) U.S. Cl.
CPC ..... *F41A 11/00* (2013.01); *F41A 23/18* (2013.01); *F41C 3/00* (2013.01)

(58) Field of Classification Search
CPC ..... F41A 35/00; F41A 11/00; F41A 29/00; F41C 27/00
USPC ..... 42/108
See application file for complete search history.

(56) References Cited

U.S. PATENT DOCUMENTS

| | | | | |
|---|---|---|---|---|
| 4,438,913 | A | 3/1984 | Hylla | |
| 4,466,537 | A * | 8/1984 | McMahan | F41C 33/0218 206/3 |
| 4,548,392 | A | 10/1985 | Rickling | |
| 5,662,219 | A * | 9/1997 | Tschudy | A45C 13/02 150/113 |
| 5,720,193 | A * | 2/1998 | Dick | E05B 37/00 211/64 |
| 6,105,951 | A * | 8/2000 | Shibata | B23Q 3/067 269/100 |
| 6,400,269 | B1 * | 6/2002 | Savastano | F41C 33/06 340/506 |
| 6,725,534 | B1 | 4/2004 | Schwartzbauer | |
| 6,761,101 | B1 * | 7/2004 | Luth | B25B 1/2457 269/54 |
| 6,880,239 | B1 | 4/2005 | Jennings et al. | |
| 7,690,606 | B1 * | 4/2010 | Batdorf | B25B 1/22 248/181.1 |

(Continued)

*Primary Examiner* — Derrick R Morgan
(74) *Attorney, Agent, or Firm* — Jonathan Brown

(57) ABSTRACT

A firearm disassembly bed system comprised of A top unit and a base unit, wherein the top unit is further comprised of either a bed having a bed depression configured to hold a firearm frame within the bed depression, at least one raised frame guide, and at least one aperture located on the surface of the top unit, wherein the base unit is comprised of a drawer capable of receiving at least one firearm component through the at least one aperture, and the firearm disassembly bed is comprised of apparatus for removeably attaching the top unit and base unit to each other. The top unit may also have a Y-block capable of being attached to the top unit.

20 Claims, 14 Drawing Sheets

(56) References Cited

U.S. PATENT DOCUMENTS 8,201,314 B2 6/2012 Miller et al.
8,209,896 B1 * 7/2012 Cashwell ..... F41A 23/18 206/317
8,281,477 B2 10/2012 Munster et al.
8,899,416 B2 * 12/2014 McDonnough ..... A45C 13/02 206/373
9,194,653 B1 * 11/2015 Jenkinson ..... F41C 27/00
9,500,439 B1 * 11/2016 Dietrich ..... F41A 3/72
2003/0121741 A1 * 7/2003 Japchen ..... A45C 13/18 190/101
2006/0053674 A1 * 3/2006 Shober ..... F41A 11/00 42/108
2007/0068835 A1 * 3/2007 Buie, II ..... F41A 23/18 206/373
2007/0294929 A1 * 12/2007 Potterfield ..... F41A 35/00 42/94
2010/0095576 A1 * 4/2010 Johns ..... F41A 21/00 42/108
2010/0126055 A1 * 5/2010 Potterfield ..... F41A 23/16 42/94
2011/0067226 A1 * 3/2011 Westbrook ..... B23B 47/28 29/559
2011/0113669 A1 * 5/2011 Oselinsky ..... F41A 29/02 42/90
2012/0005937 A1 * 1/2012 Milino ..... F41A 23/18 42/108
2012/0291330 A1 * 11/2012 Johnson ..... F41A 11/00 42/108
2013/0074393 A1 * 3/2013 Curry ..... F41A 11/00 42/108
2013/0318850 A1 * 12/2013 Holmes ..... F41C 27/00 42/90
2015/0121742 A1 * 5/2015 Wilkinson ..... F41A 11/00 42/108
2015/0159972 A1 * 6/2015 Folk ..... F41A 35/00 29/426.2
2017/0138685 A1 * 5/2017 Beasley ..... F41A 9/71
2017/0314882 A1 * 11/2017 Strombeck ..... F41A 11/00
2017/0350665 A1 * 12/2017 Borges ..... F41A 11/02
2018/0087863 A1 * 3/2018 Sexton ..... F41A 23/18

* cited by examiner

PISTOL FRAME DISASSEMBLY BED WITH SINGLE PIECE AND MULTI-PIECE CONSTRUCTIONS

CROSS REFERENCE TO RELATED APPLICATION(S)

This application is a Continuation in Part of, and claims the benefit of, U.S. Utility application Ser. No. 15/062,052 entitled "PISTOL FRAME DISASSEMBLY BED," filed on Mar. 5, 2016, the subject matter of which is hereby incorporated therein by reference in its entirety.

TECHNICAL FIELD OF THE INVENTION

The present invention relates to the general art of pistol maintenance and repair and more specifically to devices and methods for disassembly and reassembly of pistol frames.

BACKGROUND OF THE INVENTION

Manufacturers of weapons such as semi-automatic pistols, as well as other firearms, recommend that owners have them on a regularly scheduled maintenance program. Regular maintenance allows each owner and/or user to clean their pistol regularly, to perform any routine maintenance a pistol might need, to periodically inspect the pistol to remove accumulated dirt, and other foreign material and perform upgrades.

It is further and more specifically recommended that each owner/user disassemble, clean, and lubricate each pistol after each use or at least on a regularly scheduled basis. In this process the pistol frame and trigger system are disassembled so that the entire mechanism can be cleaned and/or lubricated.

However, disassembly is a chore many gun owners avoid or put off as long as possible because disassembly is often a difficult and frustrating task. To properly disassemble a firearm such as a pistol, stability of the pistol itself is required, or at the least, very helpful. Stability is difficult to achieve because pistols are not of a symmetrical shape such as a square or circle, making them awkward to hold and try to clean. A pistol has a number of small, parts and as these are removed, they must be carefully accounted for. If a pistol is being held or supported in an unstable way, the parts can slip and roll or bounce away. Depending on the size, shape and color of a part that slips away, it can be difficult or even impossible to locate. Lost parts will make a firearm unsafe or completely inoperable.

Further, tools are usually required to disassemble a pistol, such as punching tools or hammers. If a pistol is unsupported or supported inadequately, the tool may slip and scratch or otherwise damage the pistol. This kind of damage, depending on where it is on the pistol and degree, can damage the aesthetics of the firearm or even damage its functioning. If the damage is beyond aesthetic, it can present a safety issue.

To deal with this issue, a pistol can be placed in a clamp type device, as known in the art, but the pistol might be damaged at the point at which clamp pressure is being applied. Also this does not address the problem of the possibility of parts becoming separated and flying or bouncing somewhere else. The most common procedure is probably to lay a pistol out on a flat surface for disassembly. This procedure does not address either problem, as the pistol is unstable whenever worked upon, so that either parts can be lost or the pistol can be damaged.

Accordingly, there is a need in the art for a device and method that offers a steady platform for disassembling and reassembling pistols, in a safer and more controlled manner for repairs, maintenance and upgrades, that makes the pistol immobile, stable, easy to work on, and helps insure that the smaller parts of the pistol do not get lost.

SUMMARY

A Pistol Frame Disassembly Bed (PFDB) is disclosed. The PFDB is generally in the overall configuration of a box, and is comprised, generally, of a pistol bed having a bed depression for holding a pistol frame, a trigger mechanism housing aperture, and a drawer.

The top surface of the PFDB incorporates the pistol bed. The pistol bed is a three-dimensional depression, depressed in relation to the top of the PFDB. In this embodiment, a pistol to be disassembled is comprised of a slide assembly portion and a frame (receiver) portion. The pistol bed is in the shape of a side of a pistol frame (receiver) to accommodate it. The pistol bed can be sized and shaped to neatly and snugly accommodate a specific type of pistol.

The PFDB can be manufactured in any suitable size and configuration, depending upon such factors as what specific type of firearm the PFDB is to accommodate and materials of construction.

At a portion of the top of the PFDB, there can be a three-dimensional trigger mechanism housing aperture, designed specifically to hold a trigger mechanism housing.

A drawer is located at the bottom of the PFDB. The drawer is slightly smaller than the length and width of the housing of the PFDB. To open the drawer, a user simply holds the handle and pulls the drawer from the PFDB. The drawer in this embodiment is designed to open from the front; however, it can be designed for convenience sake to open from any of the four sides, depending upon the pistol model. The drawer may optionally contain a divider from front to back, or side-to-side, to help keep different parts separated, and for structural support if necessary.

The pistol bed is typically comprised of several different general areas corresponding to portions of the frame. The pistol bed is generally comprised of a forward frame area, a rear frame area, and a pistol grip receiving area.

The depth of the pistol bed will typically vary slightly among the respective areas and within each area to accommodate the shape of the frame. The pistol bed is further comprised of a depressed trigger guard area, which typically has a depth somewhat less than that of the rest of the pistol bed.

The pistol bed and bed wall can be covered in a soft material to protect the pistol frame, or a protective coating can be placed in strategic areas of the pistol bed to prevent scratching or other damage during the disassembly and reassembly process. The user will have complete control over the work as it sits in the PFDB.

The PFDB has pass-through apertures located at suitable locations as needed on the pistol bed that go through to the drawer below.

A trigger mechanism housing aperture is present in roughly the shape of a triangle with one curved side in a typical embodiment. The trigger mechanism housing aperture like the other parts herein, can be of any appropriate dimension for the pistol(s) for, which the PFDB is being used.

The materials of construction of the PFDB, or its constituent parts, can be any as known and suitable in the art, including but not limited to wood, metal, plastic or resin, or other suitable materials. The size and materials of construction of the PFDB and its individual parts may vary, depending on several factors, such as the pistol(s) the unit is designed for, the materials of construction and manufacturing process used. To achieve the desired strength, durability and efficiency of the PFDB, the planning, design and manufacturing stage will determine the exact size of the PFDB depending upon the material used.

Further, the PFDB can be produced in a number of different, or even slightly different, models. The basic pistol bed and configuration of bed wall of the PFDB can be modified to accommodate different designs, sizes and shapes of pistols, of various manufacturers.

DETAILED DESCRIPTION OF PREFERRED EMBODIMENTS

Other objects, features and advantages of the invention will become apparent from a consideration of the following detailed description and the accompanying drawings. The following descriptions are made referring to the figures, wherein like reference numbers refer to like features throughout this description. Not all numbers appearing in one figure are necessarily present in another.

Figure 1:
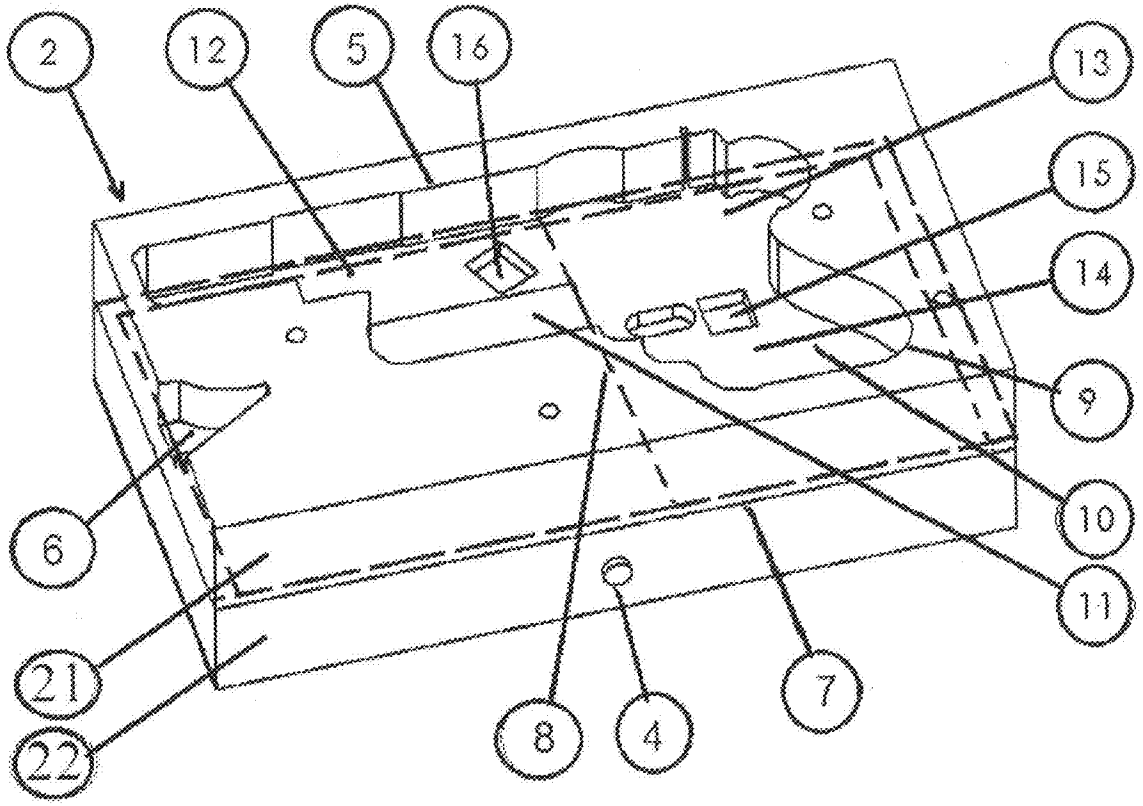
FIG. 1 is a schematic perspective view of a preferred embodiment of the invention.
Figure 2:
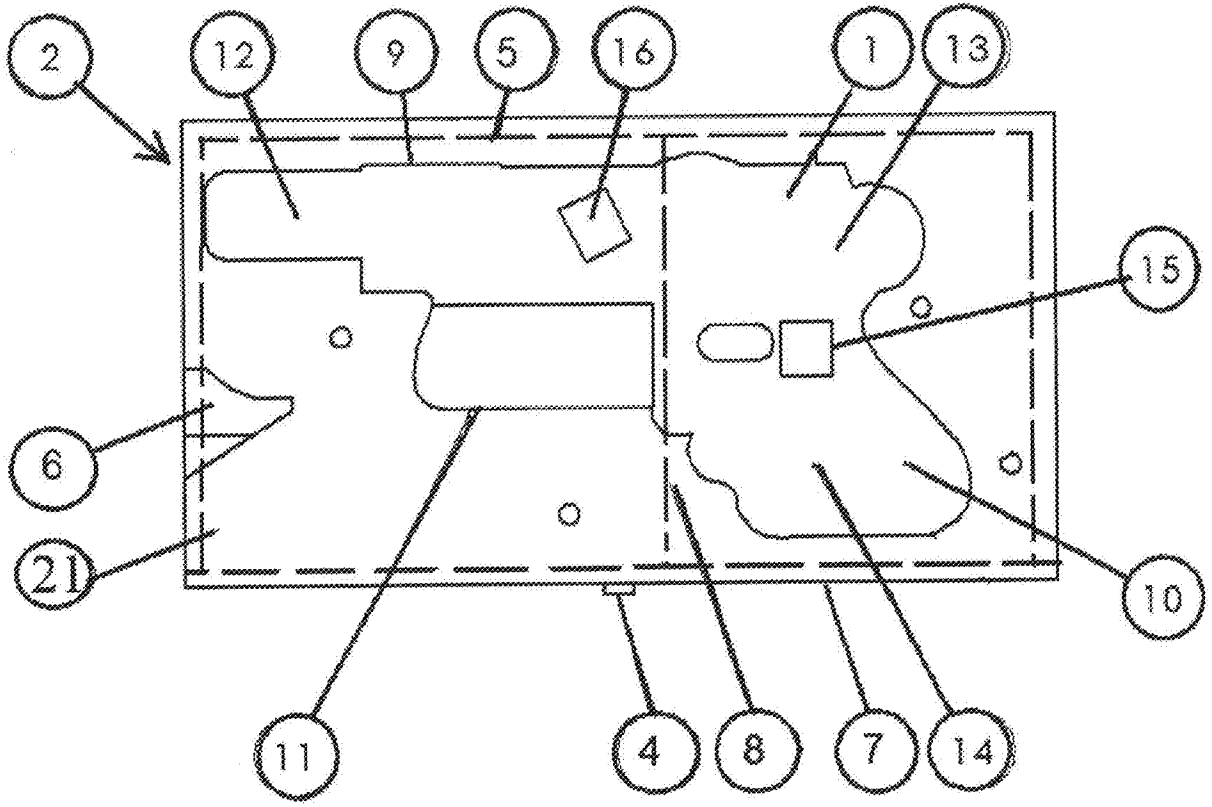
FIG. 2 is a schematic top plan view of the embodiment of FIG. 1.

Turning first to FIGS. 1-2, a Pistol Frame Disassembly Bed (hereinafter "PFDB" 2 is shown. The PFDB 2 is generally in the overall configuration of a box, and is comprised, generally, of a pistol bed 5 having a bed depression 10 for holding a pistol frame, a trigger mechanism housing aperture 6, and a drawer 7.

The PFPB 2 can be a single-unit construction, or, as in this embodiment, comprised of two units, a top unit 21 containing the pistol bed 5 and trigger mechanism housing aperture 6, and base unit containing the drawer 7 and related structures, both of which are joined together through means known in the art, such as an adhesive or other securing apparatus.

The top surface of the PFDB 2 incorporates the pistol bed 5. The pistol bed 5 is a three-dimensional depression, depressed in relation to the top of the PFDB 2. In this embodiment, a pistol to be disassembled is comprised of a slide assembly portion (Not shown) and a frame (receiver) portion 100, in FIG. 3. The pistol bed 5 is in the shape of a side of a pistol frame (receiver) 100, in FIG. 3, to accommodate it.

Figure 3:
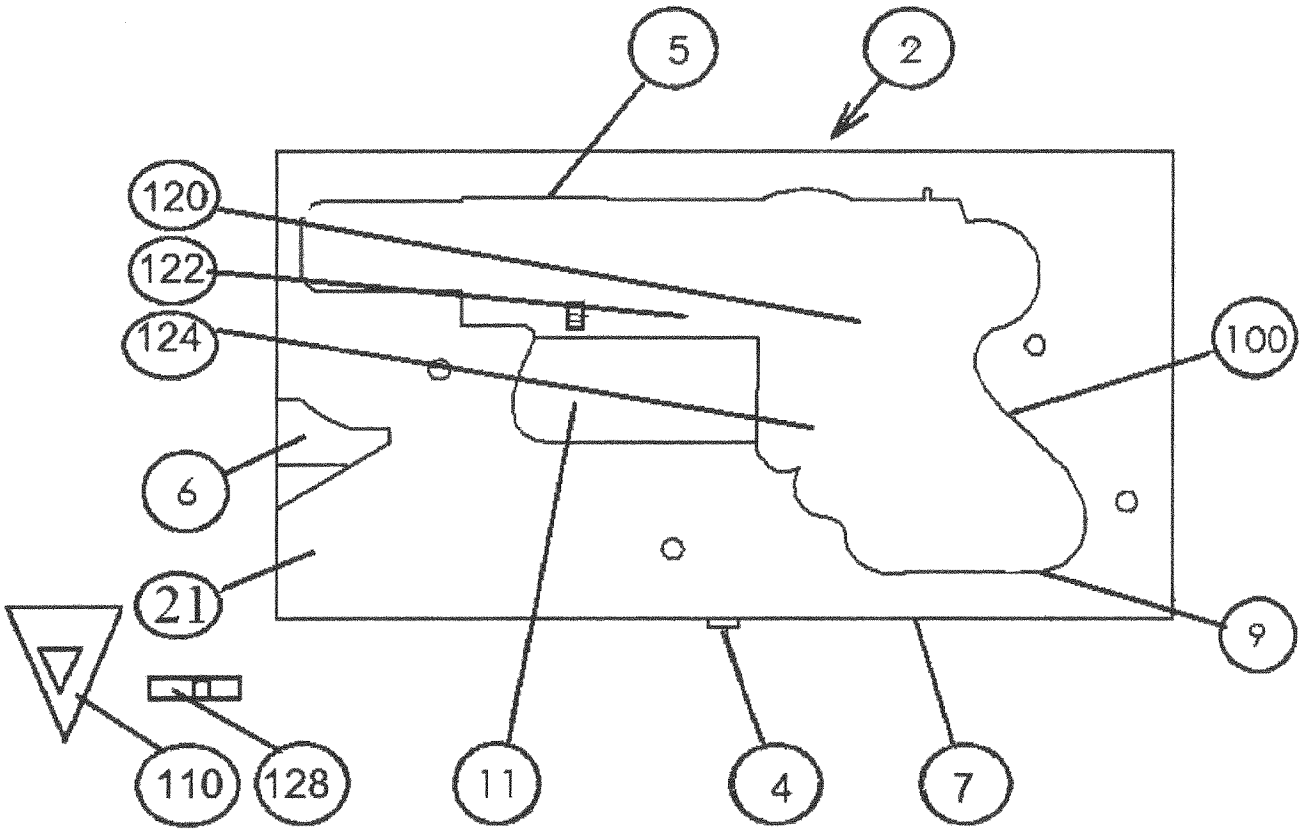
FIG. 3 is a schematic top plan view of the embodiment of FIG. 1 showing the invention in use.

When manufactured, the pistol bed 5 will be sized and shaped to neatly and snugly accommodate a specific type of pistol. In this embodiment, for example, the pistol bed 5 and pistol bed wall 9, in FIGS. 1-2, within are shaped and of a depth to specifically accommodate a Glock™ generation 1-4 pistol model. The pistol bed wall 9 is about one-half inch high to accommodate part of the frame 100, which is shown in FIG. 3.

Overall, the PFDB 2 can be manufactured in any suitable size and configuration, depending upon such factors as what specific type of firearm the PFDB 2 is to accommodate and materials of construction. In this embodiment, to accommodate a Glock™ generation 1-4 pistol, the approximate dimensions of the PFDB 2 are approximately 10"L×6"W×3H.

Figure 5:
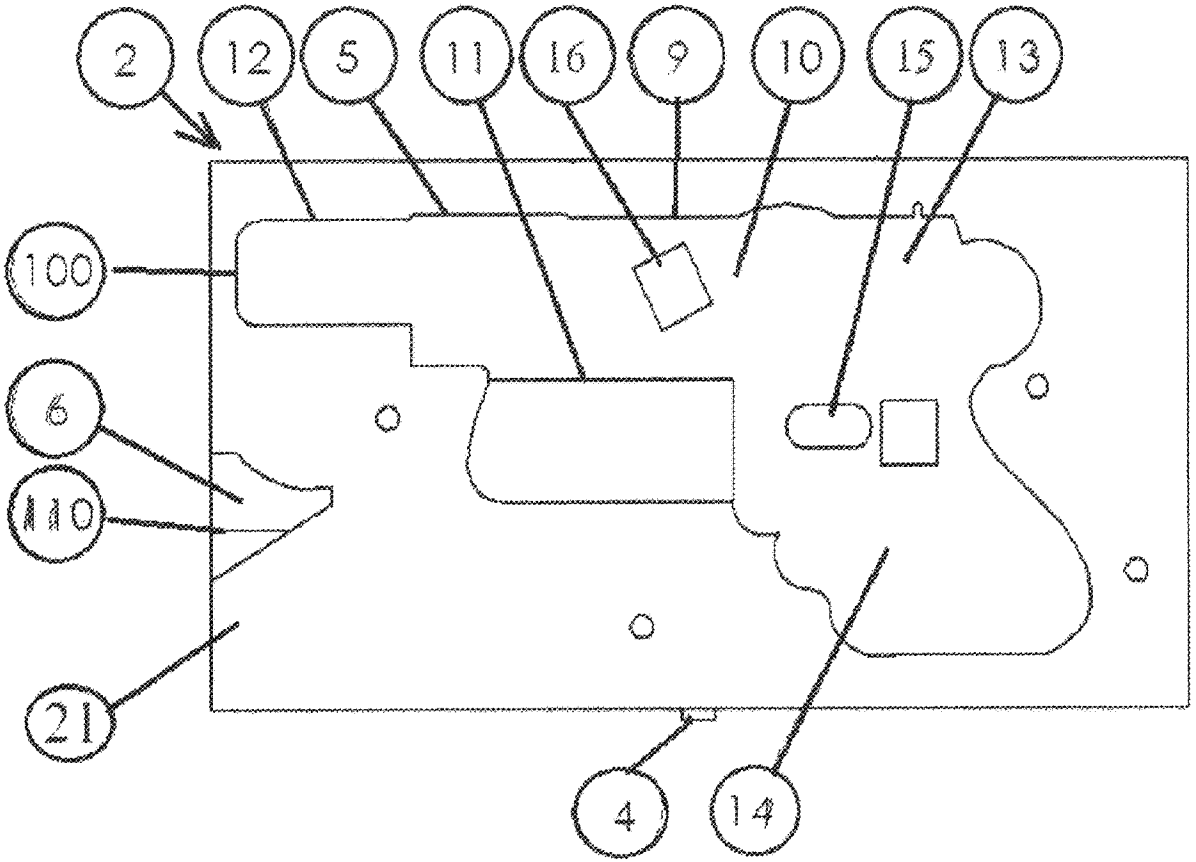
FIG. 5 is a schematic top plan view of the embodiment of FIG. 1 showing an aspect of the invention in use.

At a portion of the top of the PFDB 2, typically somewhat away from the pistol bed 5, if required by make and model, there can be a three-dimensional trigger mechanism housing aperture 6, in FIGS. 1-2, designed specifically to hold a trigger mechanism housing 110. In this embodiment, the trigger mechanism housing aperture 6 is roughly in the shape of a triangle with one curved side. Turning briefly to FIG. 5, the trigger mechanism housing aperture 6 is designed and shaped specifically to hold a Glock™ generation 1-4 pistol trigger mechanism housing with ejector 110, in FIG. 5, and in this embodiment, is located near the corner of the PFDB 2 furthest from the pistol bed 5 for convenient access.

Returning to FIGS. 1-2, a drawer 7 is located at the bottom of the PFDB 2. The drawer is slightly smaller than the length and width of the housing of the PFDB 2 and in this embodiment, it is about one inch in height. To open the drawer 7, a user simply holds the handle 4 (which can also be a recessed design drawer pull or other suitable apparatus to help open a drawer) and pulls the drawer from the PFDB 2. The drawer in this embodiment is designed to open from the front; however, it can be designed for convenience sake to open from any of the four sides, depending upon the pistol model. The drawer may optionally contain a divider 8 from front to back, or side-to-side, to help keep different parts separated, and for structural support if necessary.

Returning to discussion of the pistol bed 5, the pistol bed is typically comprised of several different general areas corresponding to portions of the frame 100, FIG. 3. In this embodiment, in FIGS. 1-2, the pistol bed 5 is generally comprised of a Forward frame area, 12, a Rear frame area 13, and a pistol grip receiving area 14.

Figure 4:
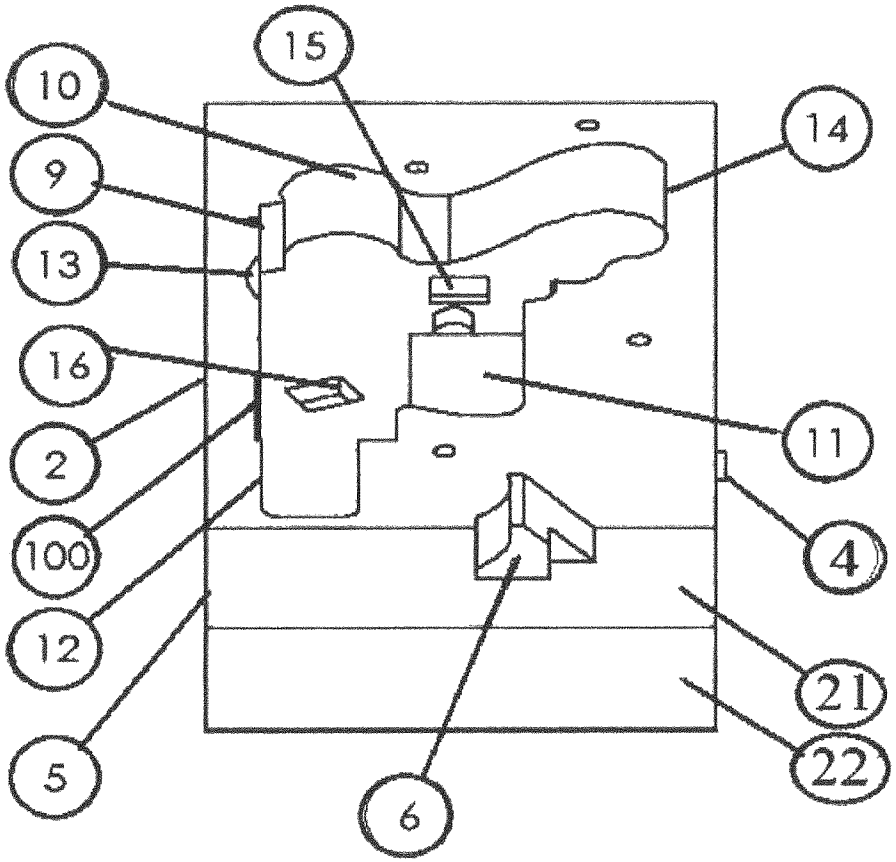
FIG. 4 is a schematic forward perspective view of the embodiment of FIG. 1.

The depth of the pistol bed 5 will typically vary slightly among the respective areas 12, 13, 14, in FIGS. 1-2, and within each area to accommodate the shape of the frame. The pistol bed 5 is further comprised of a depressed trigger guard area 11, which typically has a depth somewhat less than that of the rest of the pistol bed 5. In this embodiment the trigger guard area 11, in FIGS. 1-2, is about one-quarter inch deep to accommodate the trigger area of a Glock™ generation 1-4 pistol. Turning briefly to FIG. 4, the pistol bed 5 and bed wall 9 can be covered in a soft material to protect the pistol frame, or a protective coating can be placed in strategic areas of the pistol bed 5 to prevent scratching or other damage during the disassembly and reassembly process. The user will have complete control over the work as it sits in the PFDB 2.

The PFDB 2 has pass-through apertures, in this embodiment a pair of pass-through apertures, 15, 16, in FIG. 1-2 located at suitable locations on the pistol bed 5 that go through to the drawer 7 below.

Turning to FIG. 3, an example of use of the PFDB 2 will be discussed. A firearm, in this embodiment a Glock™ generation 1-4 pistol, is provided. As stated previously, though, the pistol to be worked on can be of any suitable type for disassembly and reassembly.

As a critical first step, the user of a PFDB 2 should always insure that the firearm is not loaded.

In a second step, the user separates the slide assembly (not shown) from the frame 100, in FIG. 3, as well as from any magazine. Any added modifications or additions to the basic frame 100 of the pistol, such as a frame mounted light or laser unit, must be removed so that the pistol frame 100 will fit into the pistol bed 5.

In a third step the user places the frame 100, FIG. 3, on its side and into the appropriate side of the pistol bed 5 into which it will fit.

In a fourth step, with the Generation 1 through Generation 4 Glock™ pistol model of this embodiment, in FIG. 3, the user removes the Locking Block Pin 120 and or Trigger Pin 124, as required by specific models, such as Glock™ models G42 and G43. The user typically will use a punch-style tool and usually a small hammer (not shown).

The pass-through apertures 15, 16 (not visible here. See FIGS. 1-2), are positioned in the pistol bed 5 such that they are directly under the pins 120, 122 124, FIG. 3, when the frame 100 is placed in the pistol bed 5. The user strikes or punches the pins 120, 122, 124, in the frame 100. The pins 120, 122, 124, when punched out, can fall safely and without damage through the pass-through apertures 15, 16 (See FIGS. 1-2) and into the removable drawer 7. The drawer 7 can not only catch and hold the pins but can also be used to store small tools, and parts (not shown) used in the maintenance process.

In a fifth step, the user can use a punch, punch-style tool, or other appropriate tool(s) to safely remove the connector. This is often done with the use of a screwdriver or similar tool which could potentially damage the connector.

Moving briefly to FIG. 5, in a sixth step, the user removes the trigger mechanism housing 110 from the frame 100, and places the trigger mechanism housing 110 in the trigger mechanism housing aperture 6, facing downward. The user can then push the connector 128 of the weapon (depicted in FIG. 3) out through the other side of the trigger mechanism housing 110. The connector falls from the trigger mechanism housing aperture 6 and into the provided recessed area.

The trigger mechanism housing aperture 6, FIG. 1-2, is roughly in the shape of a triangle with one curved side, and herein, is designed in size and shape to hold the Trigger Mechanism Housing of a Glock™ generation 1-4 pistol. The trigger mechanism housing aperture 6, FIG. 1-2, like the other parts herein, can be of any appropriate dimension for the pistol(s) for, which the PFDB 2 is being used. In this embodiment, the trigger mechanism housing aperture 6 is two inches or slightly less in length and width to accommodate a recess for capture of the connector, and it has a two-level depth of one-half inch and three-quarters of an inch, respectively.

In a seventh step, when a user wishes to reassemble the pieces, of the receiver 100, FIG. 3, the user first reassembles and installs the trigger mechanism housing 110. The user should secure the pistol frame 100 back into the pistol bed 5 for increased stability. Then the user can install (on applicable models) the trigger pin 124, the trigger housing pin 122, and the locking block pin 120. The user can hold the pistol frame 100 in place in the pistol bed 5 while tapping or pushing the pins back into the receiver 100.

The materials of construction of the PFDB 2, or its constituent parts, can be any as known and suitable in the art, including but not limited to wood, metal, plastic or resin, or other suitable materials. The size and materials of construction of the PFDB 2 and its individual parts may vary, depending on several factors, such as the pistol(s) the unit is designed for, the materials of construction and manufacturing process used. To achieve the desired strength, durability and efficiency of the PFDB 2, the planning, design and manufacturing stage will determine the exact size of the PFDB 2 depending upon the material used.

The PFDB 2 can be produced in a number of different, or even slightly different, models. For example, the basic pistol bed 5 and configuration of bed wall 9, FIG. 1-2, of the PFDB 2 can be modified to accommodate different designs, sizes and shapes of pistols, of various manufacturers. With the correct model PFDB 2, the user can perform the recommended maintenance for any pistol that requires the removal of components for disassembly and reassembly.

Additionally, and turning generally to FIGS. 6-12, other embodiments that use a multi-piece, rather than a single-piece construction, are disclosed.

Figure 6:
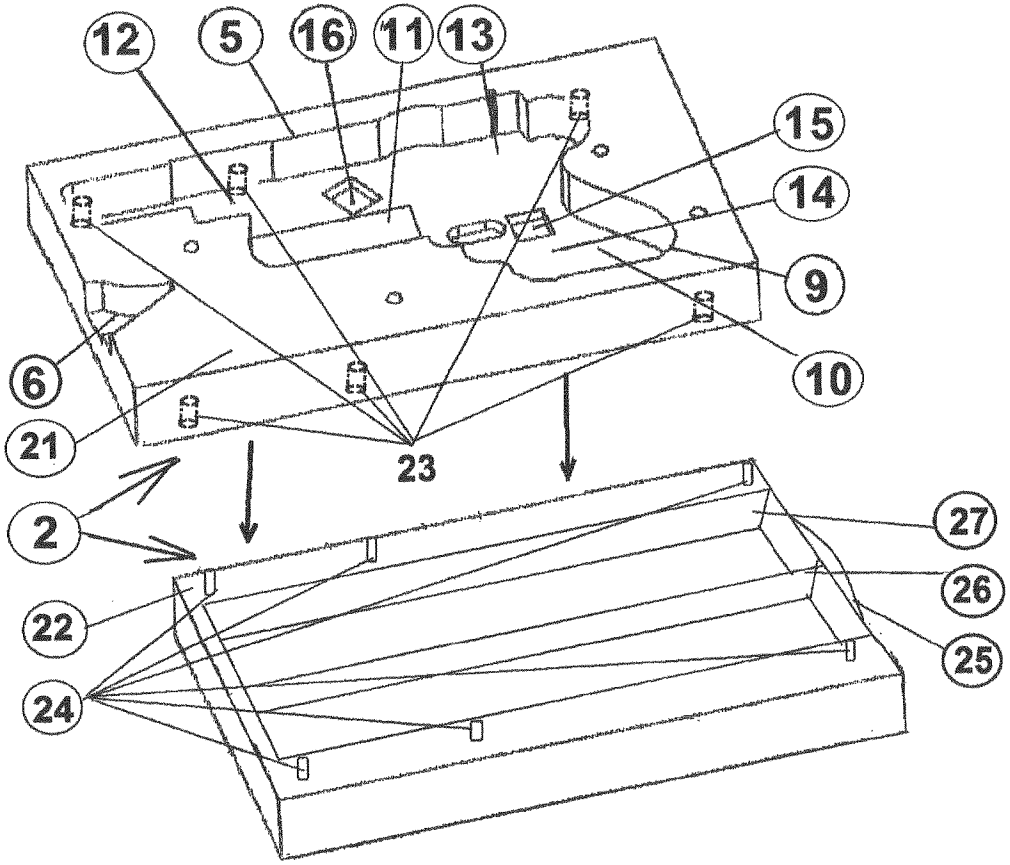
FIG. 6 is a schematic perspective view of another embodiment of the invention.

Turning to FIG. 6, a two-piece embodiment of a pistol frame disassembly bed 2 is shown. This pistol frame disassembly bed 2 is comprised overall of a top unit 21 and a base unit 22. The top unit 21 sits atop the base unit and has the bed wall 9 bed depression 10 and accompanying components and apertures from previous embodiments.

The base unit 22 has a drawer 27 that is typically (though it need not be) remove-able. The drawer 27, as is the case of the drawer in previous embodiments, can be of any suitable and known configuration for storing components and providing ease of exposure or removal of the drawer from the base unit 22. The drawer in this embodiment has a drawer pull 25 and a drawer divider 26. The divider 26 maintains separation of firearm components, such as pins, as they fall through apertures such as pass-through Apertures 15 and 16.

The top unit 21 sits atop the base unit 22 and the top unit 21 and base unit 22 have a reversible attachment mechanism 23-24 capable of being fitted together and detached when desired. The respective units can be fitted together by any suitable method in the art such as, e.g., latches and catches, hooks and hoops, or tongues and grooves. In this embodiment, the attachment mechanism 23-24 is a set of apertures 23 and posts 24. In this embodiment, the top unit 21 has a set of post apertures 23 shown in dashed lines, and the base unit 22 has a set of corresponding posts 24. The posts are placed within the respective apertures to secure the top unit 21 and base unit. The placement of the posts 24 and apertures 23 can be reversed or alternated. The top unit 21 and base unit 22 can be simply pulled apart to detach when desired. The posts 24 can be separately attached to a unit during construction or can be part of a single-piece construction of a unit.

The top unit 21 and base unit, as in previous embodiments, can be of any suitable size, shape, and depth depending on the type of firearm it will be used for. In this embodiment, the top unit 21 is about one-inch in depth and the base unit 22 is about 1.5 inches in depth. The top unit 21, base unit 22 and drawer 27 can be comprised of any suitable material or combination of materials in the art such as, but not limited to, a plastic or resin, metal, glass, wood, or rubberized material.

Figure 7:
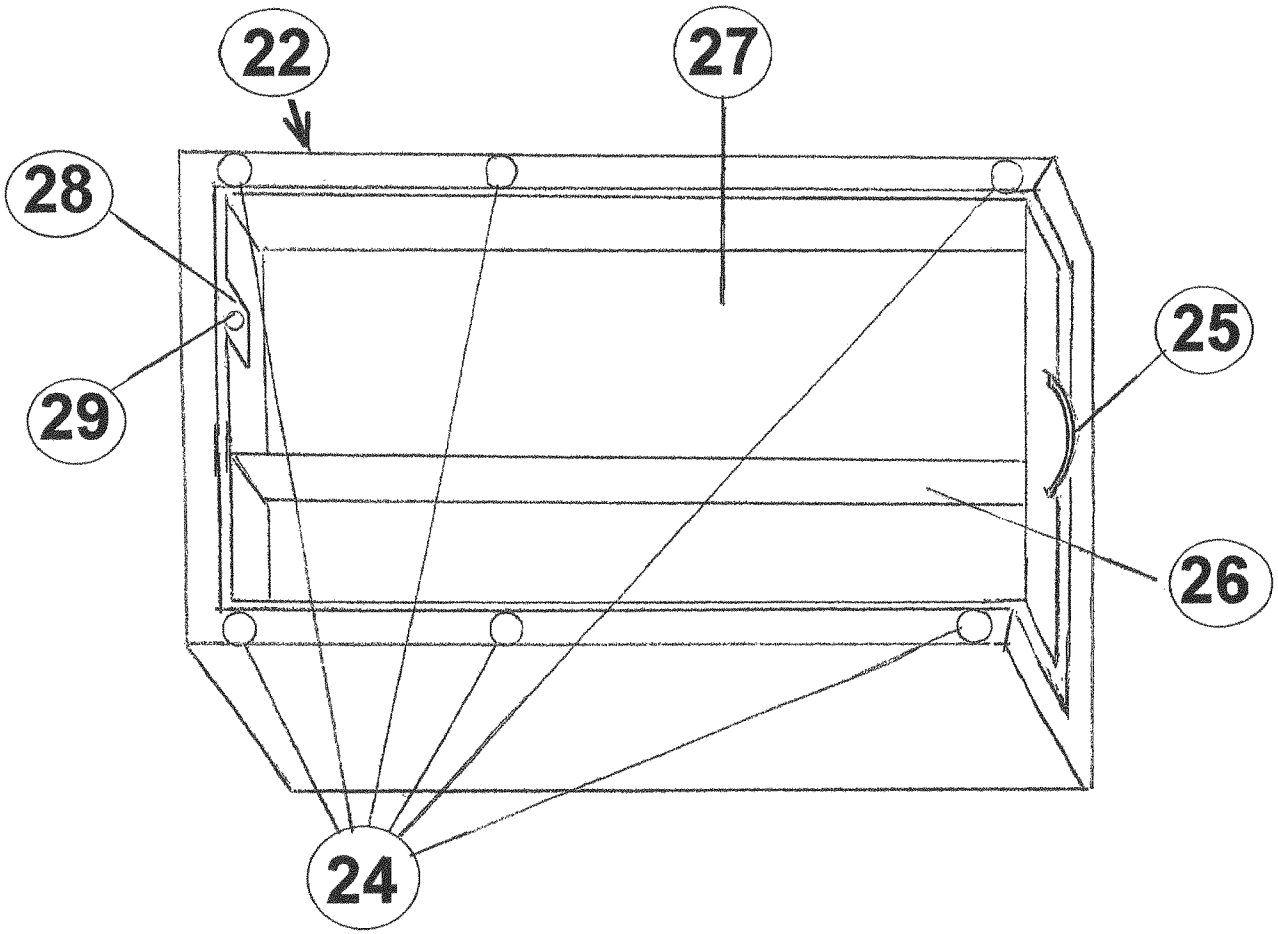
FIG. 7 is a schematic perspective bottom view of the embodiment of FIG. 6.

Turning to FIG. 7, the base unit 22 is shown in further detail. There is further a drawer recessed aperture or gap 28 and a base unit recessed cup holder 29. These work together to provide a convenient place for holding the firing pin cup. These can avoid much inconvenience, as firing pin cups are small parts that often "fly off" during maintenance and can be very difficult to find if dropped or lost.

Figure 8:
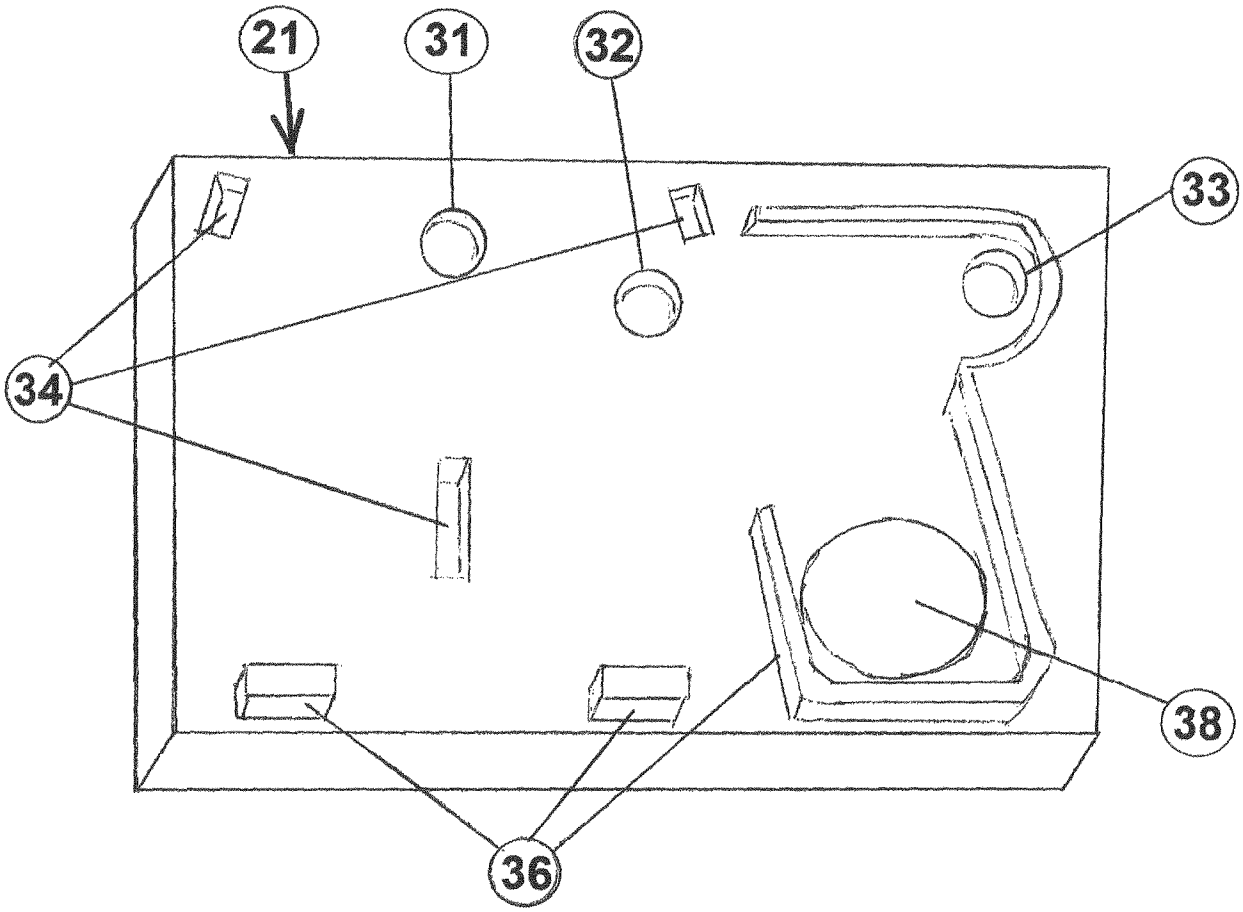
FIG. 8 is a schematic perspective top view of a further embodiment of the invention.

Turning to FIG. 8, a number of alternative types of top units can be used with the base unit 22 to support a variety of firearms and purposes. In this further embodiment, a top unit 21 capable of accommodating a Y-Block is provided. This top unit 21 has pass-through apertures 31, 32, 33 at suitable locations and a supportive pad 38 to cushion a firearm. There are Y-Block receptacle slots 34 for attaching a Y-Block (to be discussed) and a set of frame guides to help seat a firearm in the top unit 21.

The multi-piece design of this and other embodiments offers several advantages. The top units can be interchangeable with the base unit 22, so that a single base unit can be used with a number of different top units. Providing a single base unit that can accommodate a number of top units can provide a pistol frame disassembly bed 2 for a number of firearms without the need for an entire separate unit for each type of firearm. This ability to interchange different top units can reduce the cost of manufacturing the PFDB per firearm and reduce inventory space requirements at all levels of the distribution process.

Figure 8A:
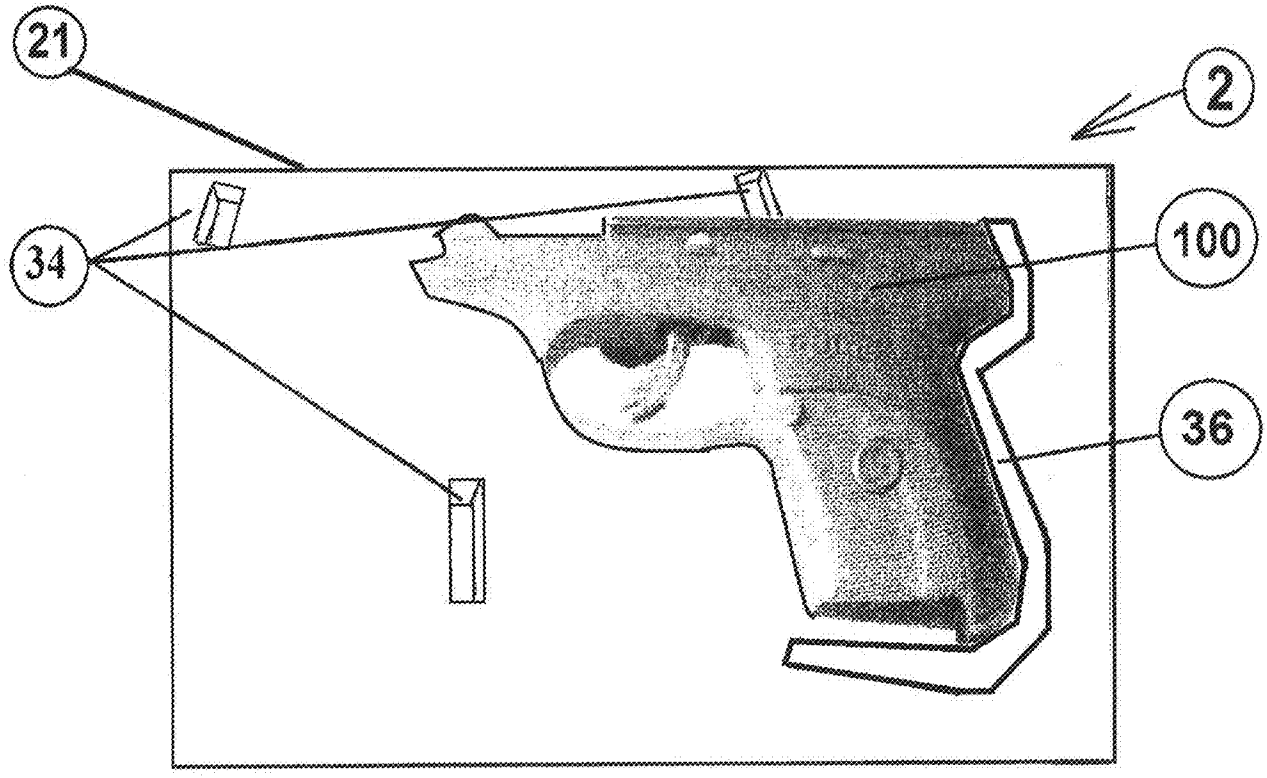
FIG. 8A is a schematic top plan view of the embodiment of FIG. 8 showing the invention in use with a firearm.

Turning to FIG. 8A, a top unit 21 holding a firearm, is shown. Of note, a single PFDB top unit can be designed to fit several different models of a pistol, provided the models are similar in size and part placement. Multiple Glock pistols, for example, can be serviced with one PFDB top unit design. Another example of several pistols of the same line that can be serviced with a single PFDB top unit design is the Ruger line known as the LC380, LC-9, LC9s and LC9SPRO hand guns. The bed for this series has a raised frame guide set 36 that is about 0.375 inches high and 0.25 inches wide, designed to match the general shape of the pistol line.

Figure 9:
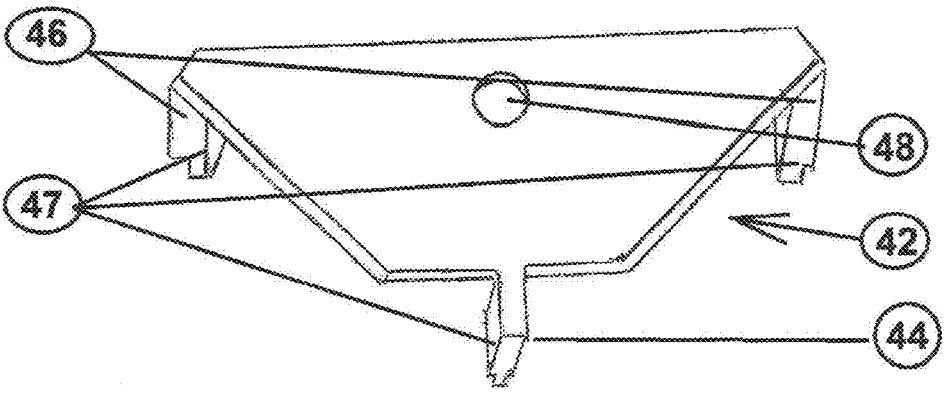
FIG. 9 is a schematic perspective view of a "Y-Block" that can be used with the embodiment of FIGS. 8-8A to create a further embodiment.
Figure 9A:
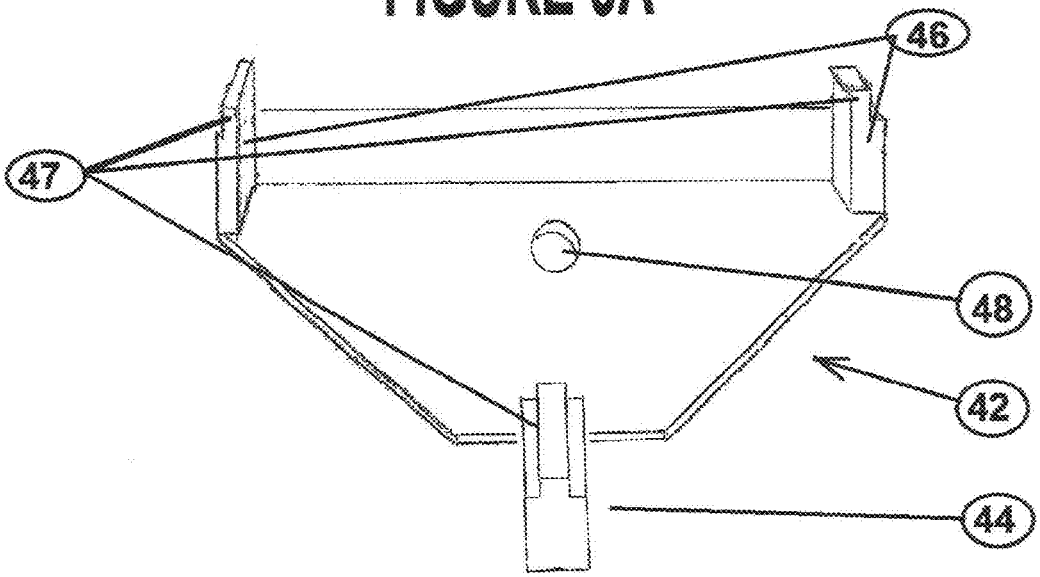
FIG. 9A is a schematic bottom perspective view of the "Y-Block of FIG. 9.

Turning to FIGS. 9 and 9A, an additional component to assist with firearm maintenance, a Y-Block 42, is shown. FIG. 9 shows the Y-Block 42 from an upper perspective view and FIG. 9A shows the same Y-Block 42 from an opposing lower perspective view. The Y-Block is comprised of at least one access aperture 48 to provide access to a specific portion of a secured firearm, and a set of supports 44, 46 that connect the Y-Block to the top unit 21 configured to accept the Y-Block. The support means in this embodiment are comprised of at least one lower key 44\ and at least one upper key 46, in this embodiment a pair of upper keys, which straddle the firearm. The number and placement of keys can be altered, depending upon factors such as the size and shape of the firearm. In this embodiment, there is one lower key 44 and a pair of upper keys 46, in a generally Y-shaped configuration.

There are also accompanying apparatus for securing the keys 44, 46 to the top unit 21. The securing apparatus can be of any suitable type in the art capable of reversibly securing a Y-Block to the top unit 21. In this embodiment, this is done by providing a set of notches 47 at the bottom of the respective upper and lower keys 44, 46 and, turning to FIG. 8, a corresponding set of Y-Block receptacle slots 34.

Figure 10:
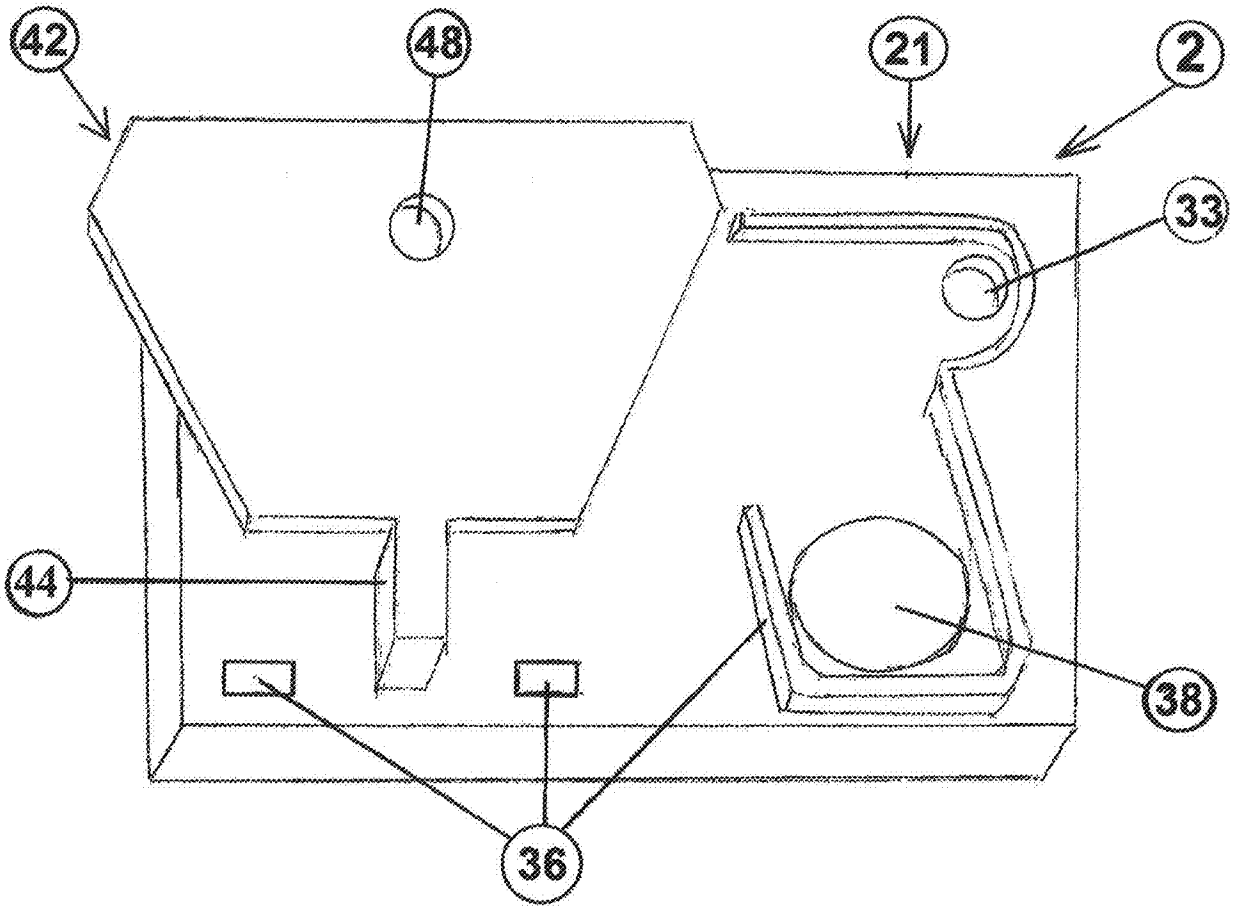
FIG. 10 is a schematic top perspective view combining the components of FIGS. 8 and 9-9A.

Turning to FIG. 10, the Y-Block 42 secured onto the top unit 21 is shown. The Y-Block 42 can be used to assist in the maintenance process for some models as necessary. The Y-Block, as with other components herein, can be of any suitable size and configuration, and constructed of any material or suitable combination of materials, within the art. The Y-Block 42 can be made, for example, of wood, a metal, resin or other plastic, rubber or rubberized materials or combination of these. In this embodiment, the Y-block is made of a plastic, and has an overall approximate size of 6.5×4×1.5 inches.

Figure 10A:
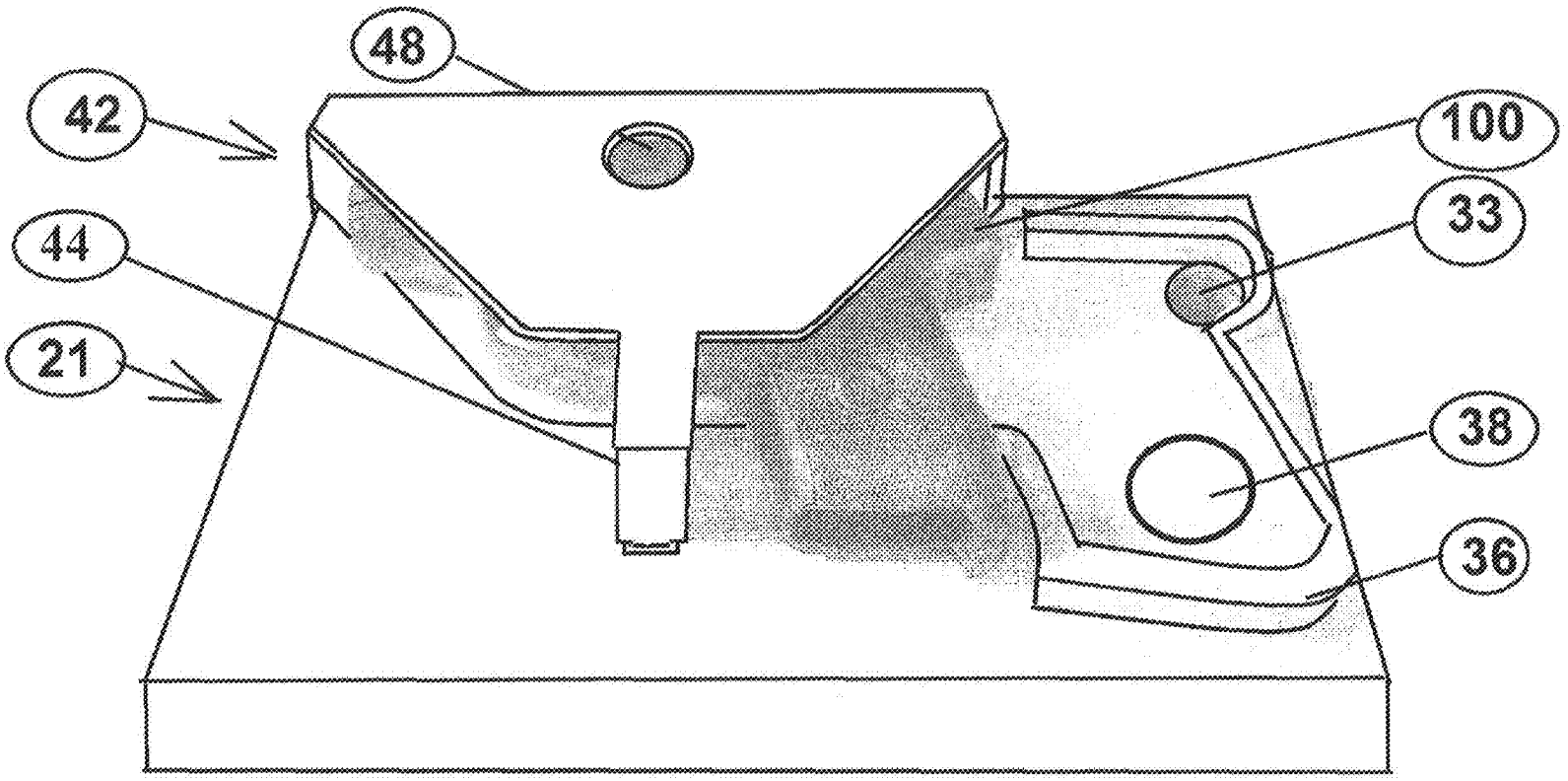
FIG. 10A is a schematic top perspective view of the embodiment of FIG. 10 showing the invention in use with a firearm.

Turning to FIG. 10A, the embodiment shown in FIG. 10 is shown, but also shows a firearm receiver 100 secured between the Y-Block 42 and the top unit 21. The Y-Block provides extra securement of a firearm or receiver 100 that allows for the use of isometric pressure to move the slide an equal but opposite distance from the frame in the disassembly process. This "Y-Block" 42 can then be used to reassemble a slide to a frame and line up specific components. It also provides cover of the trigger for safety during use of the "Y-Block". The access aperture 48, or other apertures that may be included in the Y-Block allows a user to access and work on a specific component of the receiver 100.

Figure 11:
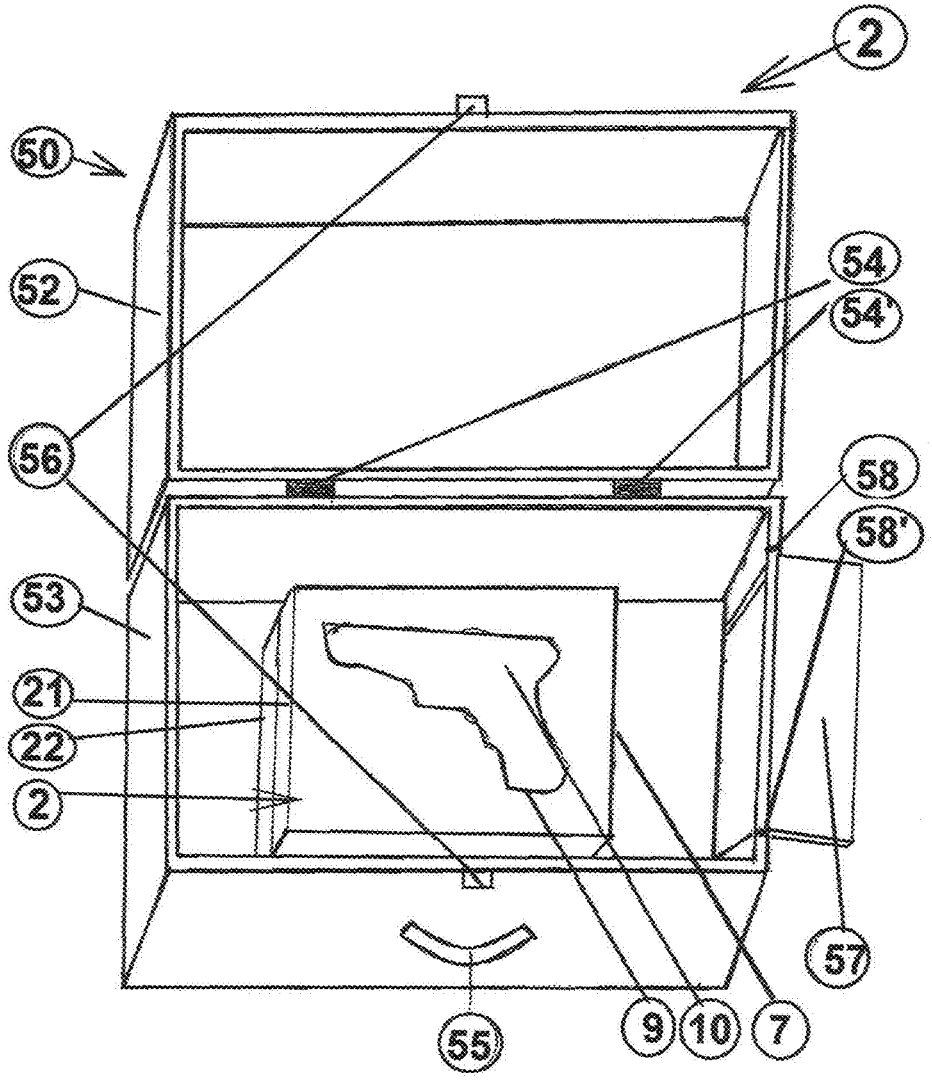
FIG. 11 is a schematic top perspective view of another embodiment featuring an improved storage system.

Turning to FIG. 11, the Pistol Frame Disassembly Bed 2 with an added component for storage or extra safety is shown. The value of a safe storage and/or carrying case for all firearms is well known in the art. A pistol storage maintenance carrying case 50 is provided.

The pistol frame disassembly bed 2 is secured within the carrying case 50. The carrying case 50 is comprised of an upper and lower section 52, 53, a set of hinges 54, 54', a handle 55 for convenient carrying and a locking device 56 for securing the pistol frame disassembly bed 2 and the weapon within the carrying case 50.

The carrying case 50 can be constructed of any suitable material or combination of materials in the art. In one embodiment, the carrying case 50 is a luggage-grade, polypropylene hinged carrying case. The carrying case 50 can, as with other components, be of any suitable size and configuration. In this embodiment, the carrying case 50 has dimensions of 12×8×8 inches.

The pistol frame disassembly bed 2 can be positioned within the carrying case 50 and means known in the art can be used to hold the pistol frame disassembly bed 2 securely in place in the lower portion 53 of the carrying case 50 during storage or transport such as, but not limited to, a set of screws or hooks and loops. Further, an access door 57 can be provided so that items can be removed from the drawer 7, or a firearm worked on while within the bed depression 10, without need to remove the pistol frame disassembly bed 2 from the carrying case 50. The access door 57 can be secured by a hinge and locking device 58.

Figure 12:
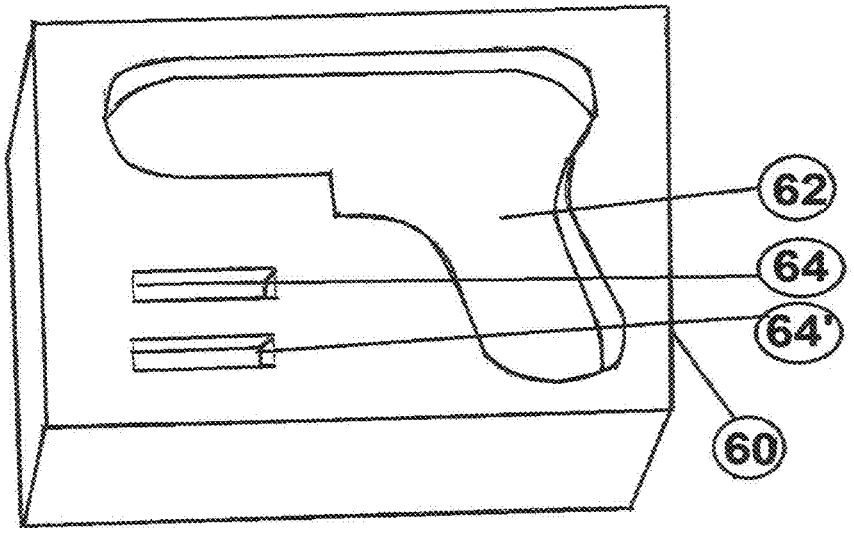
FIG. 12 is a schematic top perspective view featuring a possible further aspect of the embodiment of FIG. 11.
Figure 12A:
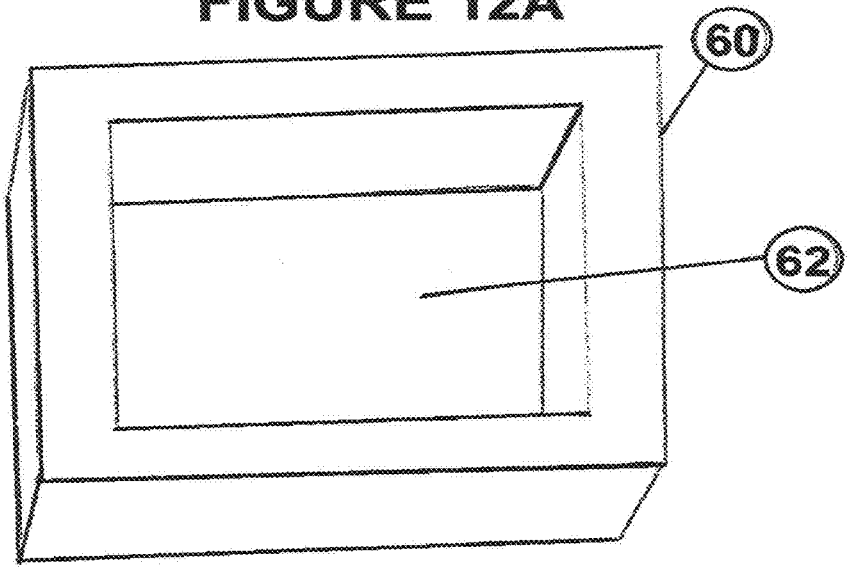
FIG. 12A is a schematic bottom perspective view of the aspect of FIG. 12.

Turning to FIGS. 12-12A, when the carrying case is being used for transport, a firearm may be placed within an additional interior pistol holding unit 60. The pistol holding unit 60 can be made of any material capable of securely cradling a firearm such as a foam, gel, rubber or rubberized material. In this embodiment, the pistol holding unit is made of foam and can be pre-scored to have within it a recessed pistol bed 62 configured to secure a firearm, and a holder for a magazine or other device 64.

Turning specifically to FIG. 12A, the top surface of the firearm holding unit 60 is designed to hold the firearm and other items such as ammunition. Another piece of foam (not shown) can be placed on top of the pistol to hold everything in place. This system allows a user to carry and store their firearm safely with little or no risk of damage, as well as have the equipment to service the weapon, all within one unit. Turning to 12*a*, the firearm holding unit is shown from beneath.

Disclosed herein is a device for assisting with the disassembly and reassembly of pistol components and for maintenance or upgrades such as the installation of improved slide locks or a trigger connector of a different pressure rating. Accordingly, a device and method of use is provided to users resulting in a steady platform with which to disassemble and reassemble pistols when necessary, which makes the pistol stable, safe, and prevents disastrous loss of parts and or damage to the pistol.

It is to be understood that while certain forms of the present invention have been illustrated and described herein, the expression of these individual embodiments is for illustrative purposes and should not be seen as a limitation upon the scope of the invention. It is to be further understood that the invention is not to be limited to the specific forms or arrangements of parts described and shown.

The invention claimed is:

1. A firearm disassembly bed system comprised of
a top unit and a base unit,
wherein the top unit is further comprised of a bed having a bed depression,
wherein the bed depression is a three-dimensional depression incorporated at the top surface of the firearm frame disassembly bed, and
wherein the bed depression is configured generally in the shape of at least a portion of a firearm frame so as to accommodate the firearm frame, and
at least one aperture located within the firearm bed depression,
and wherein the bed depression further comprises a trigger guard area,
and wherein the trigger guard area has a depth less than the remainder of the bed
depression,
and wherein the base unit further comprises a receptacle portion capable of receiving at least one firearm component through the at least one aperture,
and wherein the firearm disassembly bed further comprises an apparatus for removeably attaching the top unit and base unit to each other.

2. The firearm frame disassembly bed of claim 1, wherein the firearm is a pistol.

3. The firearm frame disassembly bed of claim 1, wherein the top unit is further comprised of a generally triangular-shaped trigger mechanism housing aperture, located on a portion of the top surface.

4. The firearm frame disassembly bed of claim 3, wherein, the trigger mechanism housing aperture is about one-and-a-half inches to about two inches in length.

5. The firearm frame disassembly bed of claim 1, wherein the receptacle portion of the base unit is at least one drawer within the base unit.

6. The firearm frame disassembly bed of claim 5, wherein the drawer is about one inch in height.

7. The firearm frame disassembly bed of claim 5, wherein the drawer is further comprised of a drawer pull and a drawer divider that divides the drawer into at least two distinct sections.

8. The firearm frame disassembly bed of claim 1, wherein the bed depression is between about one-quarter to about one-inch high.

9. The firearm frame disassembly bed of claim 8, wherein the bed depression is generally comprised of a forward frame area, a rear frame area, and a pistol grip receiving area.

10. The firearm frame disassembly bed of claim 8, wherein at least part of the bed depression is covered in a material softer than the surface of the bed depression, a protective coating or a combination of both.

11. The firearm frame disassembly bed of claim 1, wherein the dimensions of the firearm disassembly bed are about 10"L×6"W×3"H.

12. The firearm frame disassembly bed of claim 1, wherein the at least one aperture in the top unit is 2-4 apertures.

13. The firearm frame disassembly bed of claim 1, wherein the top unit and base unit are constructed of wood, metal, plastic or other resin, or combination of any of these.

14. The firearm frame disassembly bed of claim 1, wherein the top unit is further comprised of
a Y-block and
apparatus for attaching the Y-Block to the Top Unit
wherein the Y-Block is comprised of
at least one access aperture capable of providing access to a specific portion of a secured firearm, and
at least a set of supports connecting the Y-Block to the top unit.

15. The firearm frame disassembly bed of claim 1, wherein the apparatus for attaching the Y-Block to the Top Unit is comprised of
a set of keys at the bottom of the respective supports and
a respective set of apertures in the top unit for accommodating the set of keys.

16. The firearm frame disassembly bed of claim 1, wherein the apparatus for removeably attaching the top unit and base unit to each other is comprised of at least one latch and respective catch, hooks and hoops, a set of tongues and grooves, or a set of apertures and posts.

17. The firearm frame disassembly bed of claim 1, further comprising a pistol storage maintenance carrying case,
wherein the carrying case is comprised of a respective upper and lower section, a set of hinges, a handle, a locking device, and
an access door at one side of the upper or lower section.

18. The pistol storage maintenance carrying case of claim 17, further comprising a pistol holding unit, comprised of a recessed bed and capable of supporting a pistol.

19. The firearm frame disassembly bed of claim 1, wherein the top unit is further comprised of at least one raised frame guide bordering or outside the bed depression area.

20. The firearm frame disassembly bed of claim 19, wherein the at least one raised frame guide is about 0.375 inches high and 0.25 inches wide.

* * * * *